US007207561B2

(12) United States Patent
Sawai

(10) Patent No.: US 7,207,561 B2
(45) Date of Patent: Apr. 24, 2007

(54) SHEET FEEDER

(75) Inventor: Kunio Sawai, Osaka (JP)

(73) Assignee: Funai Electric Co., Ltd., Daito-shi (JP)

( * ) Notice: Subject to any disclaimer, the term of this patent is extended or adjusted under 35 U.S.C. 154(b) by 356 days.

(21) Appl. No.: 10/840,379

(22) Filed: May 7, 2004

(65) Prior Publication Data

US 2004/0251616 A1 Dec. 16, 2004

(30) Foreign Application Priority Data

May 9, 2003 (JP) ..... 2003-132031

(51) Int. Cl.
*B65H 5/02* (2006.01)

(52) U.S. Cl. ..... 271/272; 271/314; 384/627; 384/192; 384/91

(58) Field of Classification Search ..... 271/272, 271/314; 384/627, 192, 91
See application file for complete search history.

(56) References Cited

U.S. PATENT DOCUMENTS

| | | | | |
|---|---|---|---|---|
| 2,871,781 | A * | 2/1959 | Schrempp | 101/235 |
| 3,552,742 | A * | 1/1971 | Rooklyn | 271/274 |
| 6,581,930 | B2 * | 6/2003 | Kim | 271/272 |
| 6,786,663 | B2 * | 9/2004 | Kawaguchi | 400/641 |
| 6,890,114 | B2 * | 5/2005 | Kawaguchi | 400/641 |

FOREIGN PATENT DOCUMENTS

| | | |
|---|---|---|
| JP | 61-197349 | 9/1986 |
| JP | 04-206044 | 7/1992 |
| JP | 06-064981 | 3/1994 |
| JP | 10-006580 | 1/1998 |
| JP | 10-139235 | 5/1998 |

OTHER PUBLICATIONS

Japanese Office Action dated Sep. 8, 2005.

* cited by examiner

*Primary Examiner*—David H. Bollinger
(74) *Attorney, Agent, or Firm*—Crowell & Moring LLP

(57) ABSTRACT

In the sheet feeder, a first intermediate gear support shaft is inserted into a bearing of a first intermediate gear, and contains a bearing engaging part including a sectional shape having a substantial D-shaped cut having a flat part and a circular part. The bearing engaging part having a substantial D-shaped cut of the first intermediate gear support shaft contains two support parts and located on the boundary line between the flat part and the circular part. The support parts are arranged so as to support the circular bearing of the first intermediate gear at two positions sloping by a predetermined angle right and left for the line of a force which passes the center of the first intermediate gear and is applied to the first intermediate gear from the rotation. The support parts have a chamfered or rounded shape.

6 Claims, 6 Drawing Sheets

SHEET FEEDER

BACKGROUND OF THE INVENTION

1. Field of the Invention

The present invention relates to a sheet feeder. More particularly, the present invention relates to a sheet feeder provided with a feed roller for feeding a sheet.

2. Description of the Related Art

Conventionally, various sheet feeders provided with a feed roller for feeding a sheet are known (see JP-A-61-197349, JP-A-6-64981 and JP-A-10-139235).

JP-A-61-197349 discloses a sheet feeder which prevents the feeding of a sheet from being obstructed by the fact that the end of the curled sheet bumps into a feed roller by providing an auxiliary ring which smoothly introduces the end of the sheet to the contact part of a pair of feed rollers for feeding the sheet.

Furthermore, JP-A-6-64981 discloses a sheet feeder which eliminates rattle of a feed roller to a drive shaft while the feed roller is rotated by engaging an engaging hole having a substantial D-shaped cut of a fixing member attached to both side surfaces of the feed roller with a drive shaft having a sectional shape of a D-shaped cut.

Furthermore, JP-A-10-139235 discloses a sheet feeder which can reduce the number of parts by integrally forming a V-shaped elastic rib energizing a discharge roller in the direction pressing to the feed roller to the discharge roller compared with the case where the discharge roller and a member for energizing the discharge roller are separated.

FIG. 8 is a side view showing the structure of a conventional sheet feeder provided with a feed roller for feeding a sheet. FIG. 9 is an enlarged side view of the first intermediate gear of the sheet feeder according to the conventional example shown in FIG. 8. FIG. 10 is an enlarged side view of the second intermediate gear of the sheet feeder according to the conventional example shown in FIG. 8. Referring to FIG. 8, a feed roller 101 for feeding a sheet 200 is provided on a sheet feeder according to a conventional example. The feed roller 101 is provided with a rotary shaft 110*a*. A feed roller gear 101*b* is fixed to the rotary shaft 101*a* of the feed roller 101. A pinch roller 102 which presses the sheet 200 to the feed roller 101 is provided above the feed roller 101.

Furthermore, a first intermediate gear 103 for rotating the feed roller gear 101*b* is engaged with the feed roller gear 101*b*. As shown in FIG. 9, a circular bearing 103*a* is provided on the first intermediate gear 103. A circular bearing engaging part 104*a* of a first intermediate gear support shaft 104 which rotatably supports the first intermediate gear 103 is inserted into the circular bearing 103*a* of the first intermediate gear 103. The circular bearing 103*a* of the first intermediate gear 103 comes in contact with one position (P1) of the circumference of the circular bearing engaging part 104*a* of the first intermediate gear support shaft 104.

Furthermore, as shown in FIG. 8 and FIG. 10, a second intermediate gear 105 for rotating the first intermediate gear 103 is provided. The second intermediate gear 105 is provided with a small-diameter gear 105*a* engaged with the first intermediate gear 103 and a large-diameter gear 105*b* having a larger diameter than that of the small-diameter gear 105*a*. As shown in FIG. 10, a circular bearing 105*c* is formed on the second intermediate gear 105. A bearing engaging part 106*a* of a second intermediate gear support shaft 106 which rotatably supports the second intermediate gear 105 is inserted into the circular bearing 105*c* of the second intermediate gear 105. The circular bearing 105*c* of the second intermediate gear 105 comes in contact with one position (P2) of the circumference of the circular bearing engaging part 106*a* of the second intermediate gear support shaft 106.

Furthermore, as shown in FIG. 8, a driving transmission gear 107 for rotating the second intermediate gear 105 is engaged with the large diameter gear 105*b* of the second intermediate gear 105. The driving transmission gear 107 is fixed to a drive shaft 108*a* of a motor 108.

Next, referring to FIG. 8 through FIG. 10, the operation of the sheet feeder according to the conventional example showed in FIG. 8 will be described. As shown in FIG. 8, when the motor 108 is driven, the driving transmission gear 107 attached to the drive shaft 108*a* of the motor 108 is rotated in the direction of an arrow A shown in FIG. 8. The second intermediate gear 105 is rotated in the direction of an arrow B shown in FIG. 8 based on the rotation of the driving transmission gear 107.

In this case, as shown in FIG. 10, the second intermediate gear 105 accepts a force F2 as a resultant force of a force F3 applied from the driving transmission gear 107 and a force F4 applied as a drag from the first intermediate gear 103 when the first intermediate gear 103 is rotated. Thereby, since the circular bearing 105*c* of the second intermediate gear 105 is pressed to the circumference of the bearing engaging part 106*a* of the second intermediate gear support shaft 106 on the line of the force F2, frictional force of .F2 (. is coefficient of dynamic friction) acts between the bearing engaging part 106*a* and the bearing 105*c* of the second intermediate gear 105. As shown in FIG. 10, the contact position of the bearing 105*c* to the bearing engaging part 106*a* is moved to the position of P2 sloping at only an angle .3 to the rotating direction (the direction of the arrow B as shown in FIG. 10) of the second intermediate gear 105 along the circumference of the bearing engaging part 106*a* from the line of the force F2 by the frictional force .F2. The slope of the angle .3 prevents the contact point from being moved any further. That is, the frictional force .F2 for moving the contact point and a force for preventing movement at the sloping position of the angle .3. Thereby, the bearing 105*c* of the second intermediate gear 105 is rotated while coming in contact with the contact position P2 of the circumference of the bearing engaging part 106*a* of the second intermediate gear support shaft 106.

Next, the first intermediate gear 103 is rotated in the direction of an arrow E as shown in FIG. 8 based on the rotation of the second intermediate gear 105. In this case, as shown in FIG. 9, the first intermediate gear 103 accepts a force F1 as a resultant force of a force F5 applied from the second intermediate gear 105 and a force F6 applied as a drag from a feed roller gear 101*b* when the feed roller gear 101*b* is rotated. Thereby, since the circular bearing 103*a* of the first intermediate gear 103 is pressed to the circumference of the bearing engaging part 104*a* of the first intermediate gear support shaft 104 on the line of the force F1, the frictional force of .F1 (. is coefficient of dynamic friction) acts between the bearing engaging part 104*a* and the bearing 103*a* of the first intermediate gear 103. As shown in FIG. 9, the contact position of the bearing 103*a* to the bearing engaging part 104*a* is moved to the position of P1 sloping at only an angle .4 to the rotating direction (the direction of the arrow E as shown in FIG. 9) of the first intermediate gear 103 along the circumference of bearing engaging part 104*a* from the line of the force F1 by the frictional force .F1. The slope of the angle .4 prevents the contact point from being moved any further. That is, the frictional force .F1 for moving the contact point and a force for preventing movement at the sloping position of the angle .4. Thereby, the bearing 103*a* of the first intermediate gear 103 is rotated while coming in contact with the contact position. P1 of the circumference of the bearing engaging part 104*a* of the first intermediate gear support shaft 104.

The feed roller gear 101*b* is rotated in the direction of an arrow H shown in FIG. 8 based on the rotation of the first intermediate gear 103, and thereby the feed roller 101 is also rotated in the direction of the arrow H shown in FIG. 8. Thereby, the sheet 200 pressed to the feed roller 101 by a pinch roller 102 is fed in the direction of an arrow I shown in FIG. 8.

However, in the conventional sheet feeder shown in FIG. 8, the frictional force .F1 which acts between the bearing 103*a* of the first intermediate gear 103 and the circumference of the bearing engaging part 104*a* of the first intermediate gear support shaft 104 increases and decreases according to the fluctuation of the force F1 (see FIG. 9) that the first intermediate gear 103 accepts by the rotation. Thereby, the contact position P1 of the bearing 103*a* to the bearing engaging part 104*a* is inconveniently moved in a lateral direction along the circumference of the bearing engaging part 104*a*. Specifically, when the frictional force .F1 which acts between the bearing 103*a* and the circumference of the bearing engaging part 104*a* is larger by the increase of the force F1 applied by the rotation, the contact position P1 is inconveniently moved in the direction in which the angle .4 shown in FIG. 9 is larger. On the other hand, when the frictional force F1 which acts between the bearing 103*a* and the circumference of the bearing engaging part 104*a* is smaller by the decrease of the force F1 applied by the rotation, the contact position P1 is inconveniently moved in the direction in which the angle .4 shown in FIG. 9 is smaller. When the contact position P1 is moved, the first intermediate gear 103 is moved along the circumference of bearing engaging part 104*a* of the first intermediate gear support shaft 104 without being rotated. Thereby the rotational amount of the first intermediate gear 103 is fluctuated.

The frictional force .F2 which acts between the bearing 105*c* of the second intermediate gear 105 and the circumference of the bearing engaging part 106*a* of the second intermediate gear support shaft 106 increases and decreases according to the fluctuation of the force F2 (see FIG. 10) that the second intermediate gear 105 accepts by the rotation. Thereby, the contact position P2 of the bearing 105*c* to the bearing engaging part 106*a* is inconveniently moved in a lateral direction along the circumference of the bearing engaging part 106*a*. Specifically, when the frictional force .F2 which acts between the bearing 105*c* and the circumference of the bearing engaging part 106*a* is larger by the increase of the force F2 applied by the rotation, the contact position P2 is inconveniently moved in the direction in which the angle .3 shown in FIG. 10 is larger. On the other hand, when the frictional force .F2 which acts between the bearing 105*c* and the circumference of the bearing engaging part 106*a* is smaller by the decrease of the force F2 applied by the rotation, the contact position P2 is inconveniently moved in the direction in which the angle .3 shown in FIG. 10 is smaller. When the contact position P2 is moved, the second intermediate gear 105 is moved along the circumference of bearing engaging part 106*a* of the first intermediate gear support shaft 106 without being rotated. Thereby the rotational amount of the second intermediate gear 105 is fluctuated.

As described above, since the fluctuation of the rotational amounts of the first intermediate gear 103 and second intermediate gear 105 causes fluctuation of the rotational amount of the feed roller gear 101*b*, the feeding unevenness of the sheet 200 is generated. The larger the number the intermediate gear is, the larger the fluctuating amount accumulated is, and thereby the feeding unevenness of the sheet 200 is also larger. As a result, it is difficult that the feeding of the sheet 200 due to the feed roller 101 is accurately controlled.

Conventionally, to control the feeding unevenness of the sheet 200, the gap between the bearing 103*a* of the first intermediate gear 103 and the bearing engaging part 104*a* of the first intermediate gear support shaft 104, and the gap between the bearing 105*c* of second intermediate gear 105 and the bearing engaging part 106*a* of the second intermediate gear support shaft 106 are reduced to as small a volume of material as possible. Therefore, it is necessary to improve the accuracy of parts, and there is a problem that part costs rise as a result.

In the sheet feeders disclosed in JP-A-61-197349, JP-A-6-64981 and JP-A-10-139235, it is difficult to accurately control the feeding of the sheet due to the feed roller as well as the conventional sheet feeder shown in FIG. 8 since no countermeasure for suppressing the fluctuation of the rotational amount of the gear for transmitting the rotation to the feed roller is performed.

SUMMARY OF THE INVENTION

The present invention has been made to solve the above problems. It is an object of the present invention to provide a sheet feeder which can accurately control the feeding of a sheet due to a feed roller without improving the accuracy of parts.

In order to achieve the above object, a sheet feeder according to first aspect of the present invention including: a feed roller rotating around a rotary shaft and feeding a sheet; a pinch roller pressing the sheet to the feed roller; a feed roller gear provided on the rotary shaft of the feed roller; an intermediate gear having a circular bearing and rotating the feed roller gear; a driving transmission gear attached to a drive shaft of a motor and rotating the intermediate gear based on the drive of the motor; and an intermediate gear support shaft supporting the circular bearing of the intermediate gear rotatably, wherein the intermediate gear support shaft is inserted into the bearing of the intermediate gear, and contains a bearing engaging part including a sectional shape having a substantial D-shaped cut having a flat part and a circular part, wherein the bearing engaging part of the intermediate gear support shaft contains two support parts located on the boundary line between the flat part and the circular part, wherein the support parts are arranged so as to support the circular bearing of the intermediate gear at two positions sloping by a predetermined angle right and left for the line of a force which passes the center of the intermediate gear and is applied to the intermediate gear from the rotation, and wherein two support parts have a chamfered or a rounded shape.

In the sheet feeder according to a first aspect, as described above, the bearing engaging part of the intermediate gear support shaft is formed to the substantial D-shaped cut, and two support parts located on the boundary line between the flat part and the circular part of the D-shaped cut are arranged so as to support the circular bearing of the intermediate gear at two positions sloping by a predetermined angle right and left for the line of a force which passes the center of the intermediate gear and is applied to the intermediate gear from the rotation. Therefore, the bearing engaging part of the intermediate gear is not moved easily along the outer peripheral surface of the bearing engaging part of the intermediate gear support shaft compared with the case of supporting the bearing of the intermediate gear at one position on the circumference of the bearing engaging part of the intermediate gear support shaft. The frictional force which acts between the bearing of the intermediate gear and two support parts of the intermediate gear support shaft by the fluctuation of the force where the intermediate gear accepts by the rotation is fluctuated (increases and decreases). Therefore, even when a force which makes the contact position of the bearing to the bearing engaging part move in a lateral direction along the outer peripheral surface of the bearing engaging part acts, the contact position of the bearing of the intermediate gear to the bearing engaging part can be suppressed from being moved in a lateral direction along the outer peripheral surface of the bearing engaging part. Thereby, the fluctuation of the rotational amount of the intermediate gear can be suppressed, and the generation of the fluctuation of the rotational amount of the feed roller gear can be suppressed by the fluctuation of the rotational amount of the intermediate gear. As a result, the feeding unevenness of the sheet due to the feed roller can be suppressed, and the feeding of the sheet can be accurately controlled. Only the bearing engaging part of the intermediate gear support shaft is formed to the substantial D-shaped cut, and thereby the accuracy of parts need not be improved. Two support parts of the bearing engaging part of the intermediate gear support shaft are formed in a chamfered or rounded shape. Therefore, the generation of damage or the like can be suppressed on the bearing of the intermediate gear when the intermediate gear is rotated while two support parts of the bearing engaging part of the intermediate gear support shaft support the circular bearing of the intermediate gear.

A sheet feeder according to second aspect of the present invention including: a feed roller gear provided on a feed roller for feeding a sheet; a gear containing a circular bearing and rotating the feed roller gear; a driving transmission gear rotating the gear based on the drive of a motor; and a gear support shaft supporting the gear rotatably, wherein the gear support shaft is inserted into the bearing of the gear, and contains a bearing engaging part which has a circular part and a non-circular part having a shape other than the circular part, wherein the bearing engaging part contains two support parts located on the boundary line between the circular part and the non-circular part, and wherein at least one of the support parts is arranged so as to support the circular bearing of the gear at a position sloping by a predetermined angle for the line of a force which passes the center of the gear and is applied to the gear from the rotation.

In the sheet feeder according to the second aspect, as described above, a circular part and a non-circular part having a shape other than the circular part are formed on the bearing engaging part of the gear support shaft, and at least one of the two support parts located on the boundary line between the circular part and the non-circular part is arranged so as to support the circular bearing of the gear at a position sloping by a predetermined angle for the line of a force which passes the center of the gear and is applied to the gear from the rotation. Therefore, the bearing engaging part of the gear is not moved easily in at least one direction of a lateral direction along the outer peripheral surface of the bearing engaging part of the gear support shaft compared with the case of supporting the bearing of the gear at one position on the circumference of the bearing engaging part of the gear support shaft. The frictional force which acts between the bearing of the gear and two support parts of the gear support shaft by the fluctuation of the force that the gear accepts by the rotation is fluctuated (increases and decreases). Therefore, even when a force which makes the contact position of the bearing to the bearing engaging part move in a lateral direction along the outer peripheral surface of the bearing engaging part acts, the contact position of the bearing of the gear to the bearing engaging part can be suppressed from being moved in at least one direction of a lateral direction along the outer peripheral surface of the bearing engaging part. Thereby, the fluctuation of the rotational amount of the gear can be suppressed, and the generation of the fluctuation of the rotational amount of the feed roller gear can be suppressed by the fluctuation of the rotational amount of the gear. As a result, the feeding of the sheet can be accurately controlled since the feeding unevenness of the sheet due to the feed roller can be suppressed. Only the circular part and the non-circular part are formed on the bearing engaging part of the gear support shaft, and thereby the accuracy of parts need not be improved.

In the sheet feeder according to a second aspect, two support parts are preferably arranged so as to support the circular bearing of the gear at two positions sloping by a predetermined angle right and left for the line of a force which passes the center of the gear and is applied to the gear from the rotation. With such a configuration, the contact position of the bearing to the bearing engaging part is not moved easily in a lateral direction along the outer peripheral surface of the bearing engaging part. Thereby, the contact position of the bearing of the gear to the bearing engaging part can be suppressed from being moved in a lateral direction along the outer peripheral surface of the bearing engaging part even when a force which makes the contact position of the bearing to the bearing engaging part move in a lateral direction along the outer peripheral surface of the bearing engaging part acts.

In the sheet feeder according to the second aspect, the bearing engaging part of the gear support shaft preferably contains a sectional shape having a substantial D-shaped cut having a flat part and a circular part. With such a configuration, since two support parts located on the boundary line between the flat part and circular part can be formed on the bearing engaging part of the gear support shaft, the circular bearing of the gear can be easily supported by two support parts.

In the sheet feeder according to the second aspect, two support parts of the bearing engaging part of the gear support shaft preferably have a chamfered shape. With such a configuration, the generation of damage or the like can be suppressed on the bearing of the gear when the gear is rotated while two support parts of the bearing engaging part of the gear support shaft support the circular bearing of the gear.

In the sheet feeder according to the second aspect, the support parts of the bearing engaging part of the gear support shaft preferably have a rounded shape. With such a configuration, the generation of damage or the like can be suppressed on the bearing of the gear when the gear is rotated while two support parts of the bearing engaging part of the gear support shaft support the circular bearing of the gear.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Figure 1:
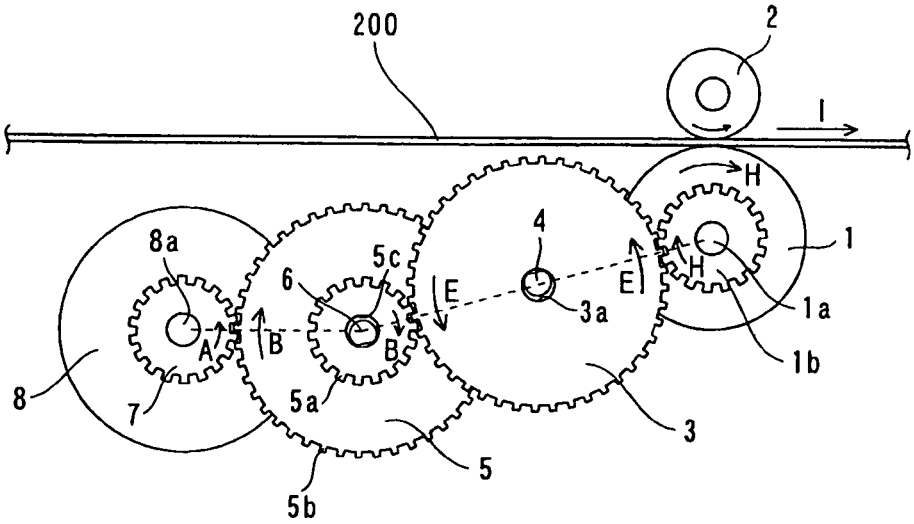
FIG. 1 is a side view showing the structure of a sheet feeder according to the first embodiment of the present invention.

Referring to the drawings, the embodiments of the present invention will be described below.

First Embodiment

Figure 2:
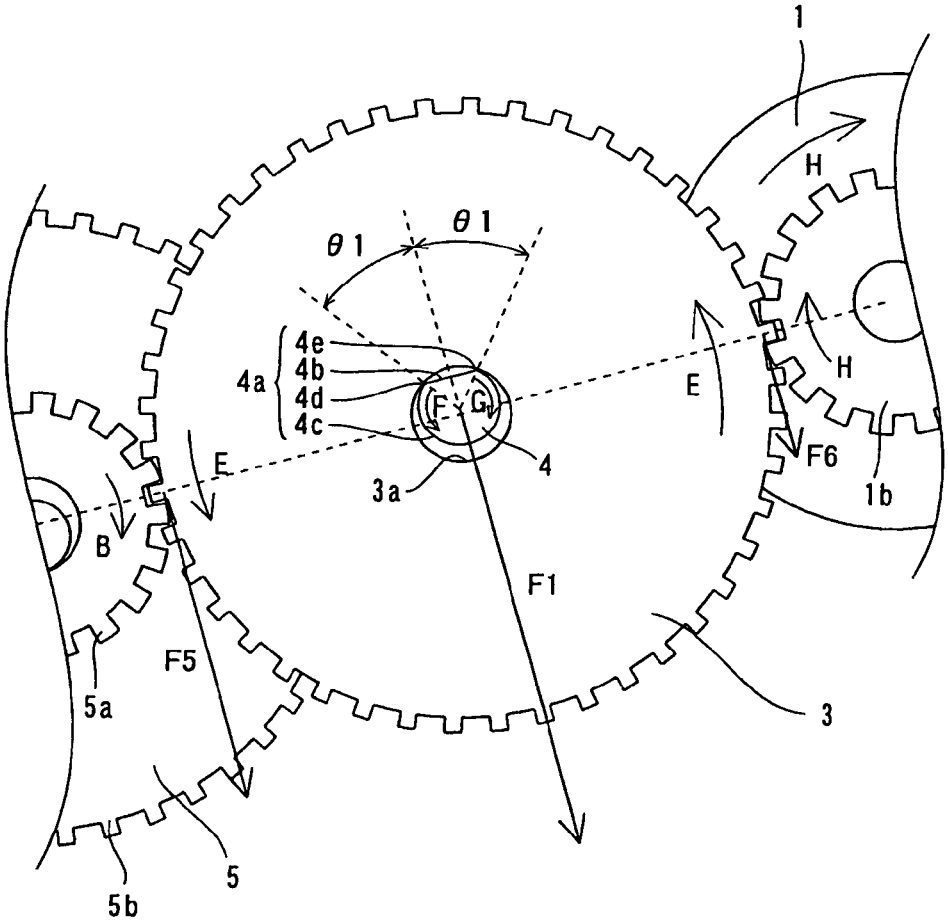
FIG. 2 is an enlarged side view of a first intermediate gear of the sheet feeder according to the first embodiment shown in FIG. 1.
Figure 3:
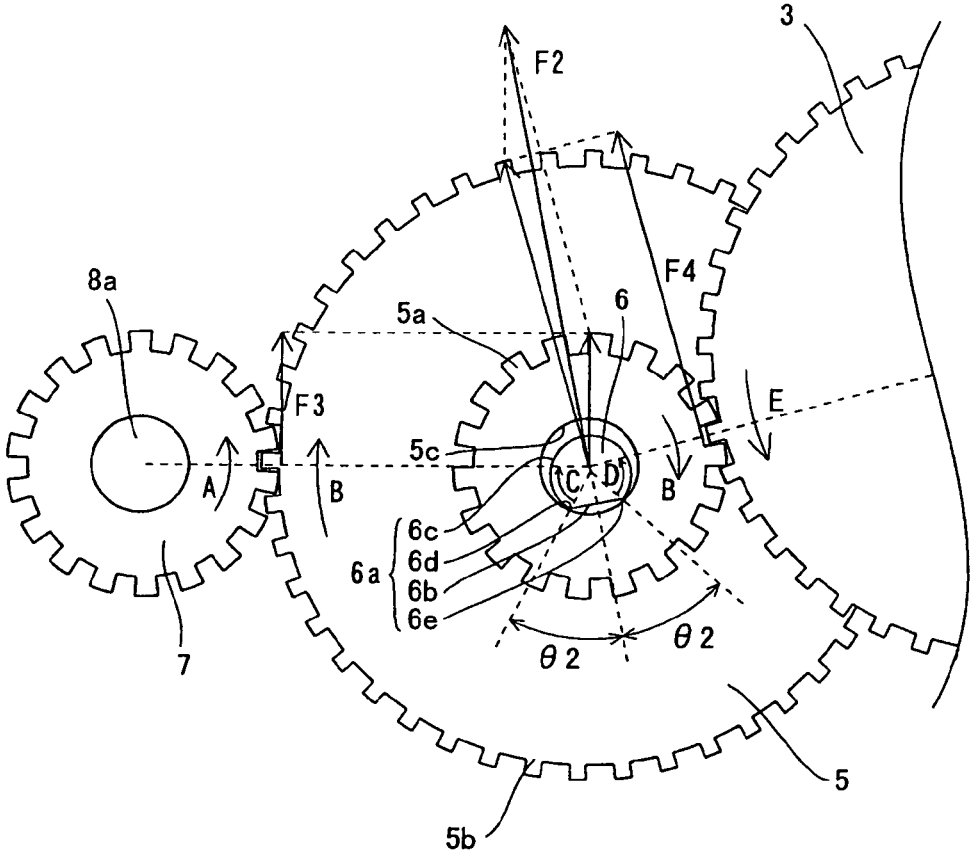
FIG. 3 is an enlarged side view of a second intermediate gear of the sheet feeder according to the first embodiment shown in FIG. 1.

FIG. 1 is a side view showing the structure of a sheet feeder according to the first embodiment of the present invention. FIG. 2 is an enlarged side view of a first intermediate gear of the sheet feeder according to the first embodiment shown in FIG. 1. FIG. 3 is an enlarged side view of a second intermediate gear of the sheet feeder according to the first embodiment shown in FIG. 1. First, referring to FIG. 1, the structure of a sheet feeder according to the first embodiment of the present invention will be described. As shown in FIG. 1, a feed roller 1 made of rubber or the like for feeding a sheet 200 is provided in a structure of the sheet feeder according to the first embodiment of the present invention. The feed roller 1 is provided with a metal rotary shaft 1*a*. A feed roller gear 1*b* made of a resin material or the like is fixed to the rotary shaft 1*a* of the feed roller 1. A pinch roller 2 which presses the sheet 200 to the feed roller and is made of a resin material or the like is provided above the feed roller 1.

A first intermediate gear 3 which rotates the feed roller gear 1*b* and is made of a resin or the like is engaged with the feed roller gear 1*b*. A circular bearing 3*a* is provided on the first intermediate gear 3 as shown in FIG. 1 and FIG. 2. A bearing engaging part 4*a* of a metal first intermediate gear support shaft 4 which rotatably supports the first intermediate gear 3 is inserted into the circular bearing 3*a* of the first intermediate gear 3. The first intermediate gear 3 is an example of "a gear" and "an intermediate gear" in the present invention. The first intermediate gear support shaft 4 is an example of "a gear support shaft" and "an intermediate gear support shaft" in the present invention.

Figure 4:
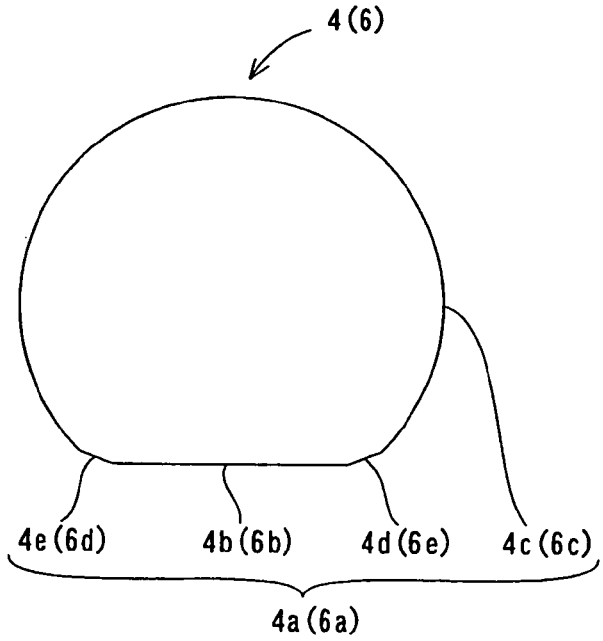
FIG. 4 is a side view showing an example of the shape of a support part of a first intermediate gear support shaft and a second intermediate gear support shaft used for the sheet feeder according to the first embodiment of the present invention.
Figure 5:
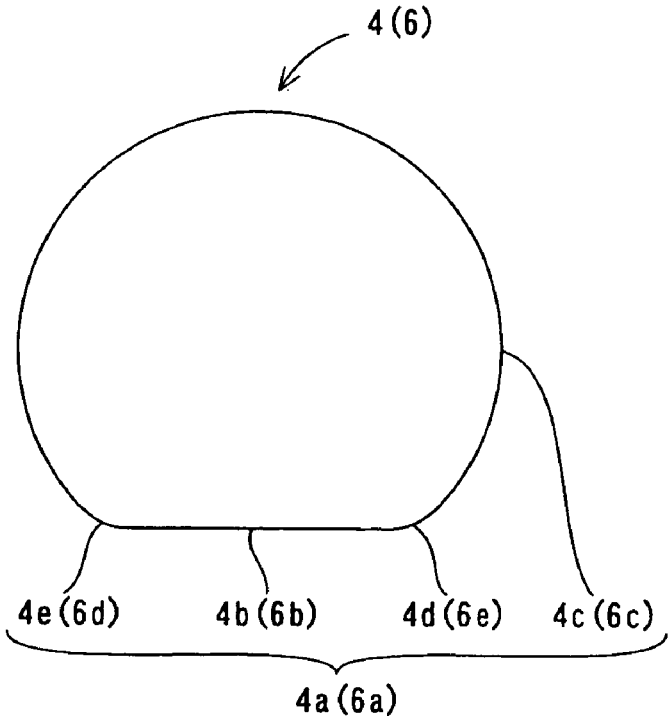
FIG. 5 is a side view showing an example of the shape of a support part of a first intermediate gear support shaft and a second intermediate gear support shaft used for the sheet feeder according to the first embodiment of the present invention.

Herein, as shown in FIG. 2, the bearing engaging part 4*a* has a sectional shape of substantial D-shaped cut in the first embodiment. The bearing engaging part 4*a* having a D-shaped cut is formed by pressing the end part of the metal first intermediate gear support shaft 4 into shapes while the metal first intermediate gear support shaft 4 is pressed into shapes. The bearing engaging part 4*a* having the substantial D-shaped cut contains a flat part 4*b* and a circular part 4*c*. The flat part 4*b* is an example of "a non-circular part" in the present invention. The bearing engaging part 4*a* having the substantial D-shaped cut contains two support parts 4*d* and 4*e* located on the boundary line between the flat part 4*b* and the circular part 4*c*. As shown in FIG. 2, the support parts 4*d* and 4*e* are arranged so as to support the circular bearing 3*a* of the first intermediate gear 3 at two positions sloping by an equal angle .1 (.1=approx. 10.–45.) right and left for the line of a force F1 which is applied to the first intermediate gear 3 from the rotation. The support parts 4*d* and 4*e* have a chamfered shape shown in FIG. 4 or a rounded shape shown in FIG. 5.

As shown in FIG. 1 and FIG. 3, a second intermediate gear 5 made of a resin or the like for rotating the first intermediate gear 3 is provided. The second intermediate gear 5 is provided with a small-diameter gear 5*a* engaged with the first intermediate gear 3 and a large diameter gear 5*b* having a larger diameter than that of the small-diameter gear 5*a*. A circular bearing 5*c* is formed on the second intermediate gear 5 as shown in FIG. 3. A bearing engaging part 6*a* of a metal second intermediate gear support shaft 6 which rotatably supports the second intermediate gear 5 is inserted into the circular bearing 5*c* of the second intermediate gear 5. The second intermediate gear 5 is an example of "a gear" and "an intermediate gear" in the present invention. The second intermediate gear support shaft 6 is an example of "a gear support shaft" and "an intermediate gear support shaft" in the present invention.

Herein, the bearing engaging part 6*a* has a sectional shape of a substantial D-shaped cut in the first embodiment. The bearing engaging part 6*a* having a D-shaped cut is formed by pressing the end part of the metal second intermediate gear support shaft 6 into shapes while the metal second intermediate gear support shaft 6 is pressed into shapes. The bearing engaging part 6*a* having the substantial D-shaped cut contains a flat part 6*b* and a circular part 6*c*. The flat part 6*b* is an example of "a non-circular part" in the present invention. The bearing engaging part 6*a* having the substantial D-shaped cut contains two support parts 6*d* and 6*e* located on the boundary line between the flat part 6*b* and the circular part 6*c*. As shown in FIG. 3, the support parts 6*d* and 6*e* are arranged so as to support the circular bearing 5*c* of the second intermediate gear 5 at two positions sloping by an equal angle .2 (.2=approx. 10.–45.) right and left for the line of a force F2 which is applied to the second intermediate gear 5 from the rotation. The support parts 6*d* and 6*e* have a chamfered shape shown in FIG. 4 or a rounded shape shown in FIG. 5.

As shown in FIG. 1, the large-diameter gear 5*b* of the second intermediate gear 5 is engaged with a driving transmission gear 7 for rotating the second intermediate gear 5. The driving transmission gear 7 is fixed to a drive shaft 8*a* of a motor 8.

Next, referring to FIG. 1 through FIG. 3, the operation of the sheet feeder according to the first embodiment will be described. First, referring to FIG. 1, when the motor 8 is driven, the driving transmission gear 7 attached to the drive shaft 8*a* of the motor 8 is rotated in the direction of an arrow A in FIG. 1. The second intermediate gear 5 is rotated in the direction of an arrow B shown in FIG. 1 based on the rotation of the driving transmission gear 7.

In this case, as shown in FIG. 3, the second intermediate gear 5 accepts a force F2 as resultant force of a force F3 applied from the driving transmission gear 7 and a force F4 applied as a drag from the first intermediate gear 3 when the first intermediate gear 3 is rotated. Thereby, since the circular bearing 5*c* of the second intermediate gear 5 is pressed to two support parts 6*d* and 6*e* of the bearing engaging part 6*a* of the second intermediate gear support shaft 6, frictional force acts between two support parts 6*d* and 6*e* and the bearing 5*c* of the second intermediate gear 5. The frictional force increases and decreases based on the fluctuation of the force F2 that the second intermediate gear 5 accepts from the rotation. A force for moving the contact position of the bearing 5*c* to the bearing engaging part 6*a* in a lateral direction along the outer peripheral surface of the bearing engaging part 6*a* acts by the fact that the frictional force increases and decreases. Specifically, when the force F2 increases, the frictional force which acts between the bearing 5*c* and two support parts 6*d* and 6*e* is larger. In this case, a force for moving the contact position of the bearing 5*c* to the bearing engaging part 6*a* in the direction of an arrow C shown in FIG. 3 along the outer peripheral surface of the bearing engaging part 6*a* acts. On the other hand, when the force F2 decreases, the frictional force which acts between the bearing 5*c* and two support parts 6*d* and 6*e* is smaller. In this case, a force for moving the contact position of the bearing 5*c* to the bearing engaging part 6*a* in the direction of an arrow D shown in FIG. 3 along the outer peripheral surface of the bearing engaging part 6*a* acts.

In this case, in the first embodiment, since two support parts 6*d* and 6*e* support the bearing 5*c* of the second intermediate gear 5 at two positions sloping by each angle .2 right and left for the line of the force F2 that the second intermediate gear 5 accepts by the rotation, the bearing 5C of the second intermediate gear 5 is not moved easily along the outer peripheral surface of the bearing engaging part 6*a* of the second intermediate gear support shaft 6 compared with the case of supporting the bearing 5*c* of the second intermediate gear 5 at one position. Thereby, even when a force making the contact position of the bearing 5*c* of the second intermediate gear 5 to the bearing engaging part 6*a* move in a lateral direction along the outer peripheral surface of bearing engaging part 6*a* acts, the contact position of the bearing 5*c* to the bearing engaging part 6*a* is suppressed from being moved in a lateral direction along the outer peripheral surface of the bearing engaging part 6*a*. Specifically, when a force for moving the contact position of the bearing 5*c* to the bearing engaging part 6*a* in the direction of an arrow C shown in FIG. 3 along the outer peripheral surface of bearing engaging part 6*a* acts, the circular bearing 5*c* comes in contact with the support part 6*d* at a position sloping at only angle .2 in a left direction shown in FIG. 3. Thereby, the contact position of the bearing 5*c* to the bearing engaging part 6*a* is suppressed from being moved in the direction of an arrow C shown in FIG. 3 along the outer peripheral surface of bearing engaging part 6*a*. On the other hand, when a force for moving the contact position of the bearing 5*c* to the bearing engaging part 6*a* in the direction of an arrow D shown in FIG. 3 along the outer peripheral surface of the bearing engaging part 6*a* acts, the circular bearing 5*c* comes in contact with the support part 6*e* at a position sloping at only angle .2 in a right direction shown in FIG. 3. Thereby, the contact position of the bearing 5*c* to the bearing engaging part 6*a* is suppressed from being moved in the direction of an arrow D shown in FIG. 3 along the outer peripheral surface of the bearing engaging part 6*a*.

Next, the first intermediate gear 3 is rotated in the direction of an arrow E as shown in FIG. 1 based on the rotation of the second intermediate gear 5. In this case, as shown in FIG. 2, the first intermediate gear 3 accepts a force F1 as a resultant force of a force F5 applied from the second intermediate gear 5 and a force F6 applied from a feed roller gear 1*b* when the feed roller gear 1*b* is rotated. Thereby, since the circular bearing 3*a* of the first intermediate gear 3 is pressed to two support parts 4*d* and 4*e* of the bearing engaging part 4*a* of the first intermediate gear support shaft 4, the frictional force acts between two support parts 4*d* and 4*e* and the bearing 3*a* of the first intermediate gear 3. The frictional force increases and decreases based on the fluctuation of the force F1 that the first intermediate gear 3 accepts from the rotation. A force for moving the contact position of the bearing 3*a* to the bearing engaging part 4*a* in a lateral direction along the outer peripheral surface of the bearing engaging part 4*a* acts by the fact that the frictional force increases and decreases. Specifically, when the force F1 increases, the frictional force which acts between the bearing 3*a* and two support parts 4*d* and 4*e* is larger. In this case, a force for moving the contact position of the bearing 3*a* to the bearing engaging part 4*a* in the direction of an arrow F shown in FIG. 2 along the outer peripheral surface of the bearing engaging part 4*a* acts. On the other hand, when the force F1 decreases, the frictional force which acts between the bearing 3*a* and two support parts 4*d* and 4*e* is smaller. In this case, a force for moving the contact position of the bearing 3*a* to the bearing engaging part 4*a* in the direction of an arrow G shown in FIG. 2 along the outer peripheral surface of the bearing engaging part 4*a* acts.

In this case, in the first embodiment, since two support parts 4*d* and 4*e* support the bearing 3*a* of the first intermediate gear 3 at two positions sloping by each angle 0.1 right and left to the line of force F1 that the first intermediate gear 3 accepts by the rotation, the bearing 3*a* of the first intermediate gear 3 is not moved easily along the outer peripheral surface of the bearing engaging part 4*a* of the first intermediate gear support shaft 4 compared with the case of supporting the bearing 3*a* of the first intermediate gear 3 at one position. Thereby, even when a force making the contact position of the bearing 3*a* of the first intermediate gear 3 to the bearing engaging part 4*a* move in a lateral direction along the outer peripheral surface of bearing engaging part 4*a* acts, the contact position of the bearing 3*a* to the bearing engaging part 4*a* is suppressed from being moved in a lateral direction along the outer peripheral surface of the bearing engaging part 4*a*. Specifically, when a force for moving the contact position of the bearing 3*a* to the bearing engaging part 4*a* in the direction of an arrow F shown in FIG. 2 along the outer peripheral surface of bearing engaging part 4*a* acts, the circular bearing 3*a* comes in contact with the support 4*d* at a position sloping at only angle .1 in a left direction shown in FIG. 2. Thereby, the contact position of the bearing 3*a* to the bearing engaging part 4*a* is suppressed from being moved in the direction of an arrow F shown in FIG. 2 along the outer peripheral surface of bearing engaging part 4*a*. On the other hand, when a force for moving the contact position of the bearing 3*a* to the bearing engaging part 4*a* in the direction of an arrow G shown in FIG. 2 along the outer peripheral surface of the bearing engaging part 4*a* acts, the circular bearing 3*a* comes in contact with the support part 4*e* at a position sloping at only angle .1 in a right direction shown in FIG. 2. Thereby, the contact position of the bearing 3*a* to the bearing engaging part 4*a* is suppressed from being moved in the direction of an arrow G shown in FIG. 2 along the outer peripheral surface of bearing engaging part 4*a*.

Next, the feed roller gear 1*b* is rotated in the direction of an arrow H shown in FIG. 1 based on the rotation of the first intermediate gear 3, and thereby the feed roller 1 is also rotated in the direction of the arrow H shown in FIG. 1. Thereby, the sheet 200 pressed to the feed roller 1 by a pinch roller 2 is fed in the direction of an arrow I shown in FIG. 1.

In the first embodiment, as described above, the bearing engaging part 4*a* of the first intermediate gear support shaft 4 is formed to the substantial D-shaped cut, and two support parts 4*d* and 4*e* located on the boundary line between the flat part 4*b* and the circular part 4*c* of the D-shaped cut are arranged so as to support the circular bearing 3*a* of the first intermediate gear 3 at two positions sloping by a predetermined angle .1 right and left for the line of a force F1 which passes the center of the first intermediate gear 3 and is applied to the first intermediate gear 3 from the rotation. Therefore, the bearing engaging part 3*a* of the first intermediate gear 3 is not moved easily along the outer peripheral surface of the bearing engaging part 4*a* of the first intermediate gear support shaft 4 compared with the case of supporting the bearing 3*a* of the intermediate gear 3 at one position on the circumference of the bearing engaging part 4*a* of the first intermediate gear support shaft 4. Therefore, the frictional force which acts between the bearing 3*a* of the first intermediate gear 3 and two support parts 4*d* and 4*e* of the intermediate gear support 4 shaft by the fluctuation of the force that the first intermediate gear 3 accepts by the rotation is fluctuated (increases and decreases). Therefore, even when a force which makes the contact position of the bearing 3*a* to the bearing engaging part 4*a* move in a lateral direction along the outer peripheral surface of the bearing engaging part 4*a* acts, the contact position of the bearing 3*a* of the first intermediate gear 3 to the bearing engaging part 4*a* can be suppressed from being moved in a lateral direction along the outer peripheral surface of the bearing engaging part 4*a*. The bearing engaging part 6*a* of the second intermediate gear support shaft 6 has a configuration identical to the bearing engaging part 4*a* of the first intermediate gear support shaft 4, and thereby the contact position of the bearing 5*c* to the bearing engaging part 6*a* is suppressed from being moved in a lateral direction along the outer peripheral surface of the bearing engaging part 6*a*. Thereby, the fluctuation of the rotational amounts of the first intermediate gear 3 and the second intermediate gear 5 can be suppressed, and the generation of the fluctuation of the rotational amount of the feed roller gear 1*b* can be suppressed by the fluctuation of the rotational amounts of the first intermediate gear 3 and the second intermediate gear 5. As a result, the feeding of the sheet 200 can be accurately controlled since the feeding unevenness of the sheet 200 due to the feed roller 1 can be suppressed. Only the bearing engaging parts 4*a* and 6*a* of the first intermediate gear support shaft 4 and the second intermediate gear support shaft 6 are formed to the substantial D-shaped cut, and thereby the accuracy of parts need not be improved.

In the first embodiment, as described above, two support parts 4*d* and 4*e* (6*d*, 6*e*) of the bearing engaging parts 4*a* and 6*a* of the first intermediate gear support shaft 4 and the second intermediate gear support shaft 6 have a chamfered shape or have a rounded shape. Therefore, the generation of damage or the like can be suppressed to the bearings 3*a* and 5*c* of the first intermediate gear 3 and the second intermediate gear 5 when the first intermediate gear 3 and the second intermediate gear 5 are rotated while two support parts 4*d* and 4*e* (6*d*, 6*e*) support the circular bearings 3*a* and 5*c* of the first intermediate gear 3 and the second intermediate gear 5.

Second Embodiment

Figure 6:
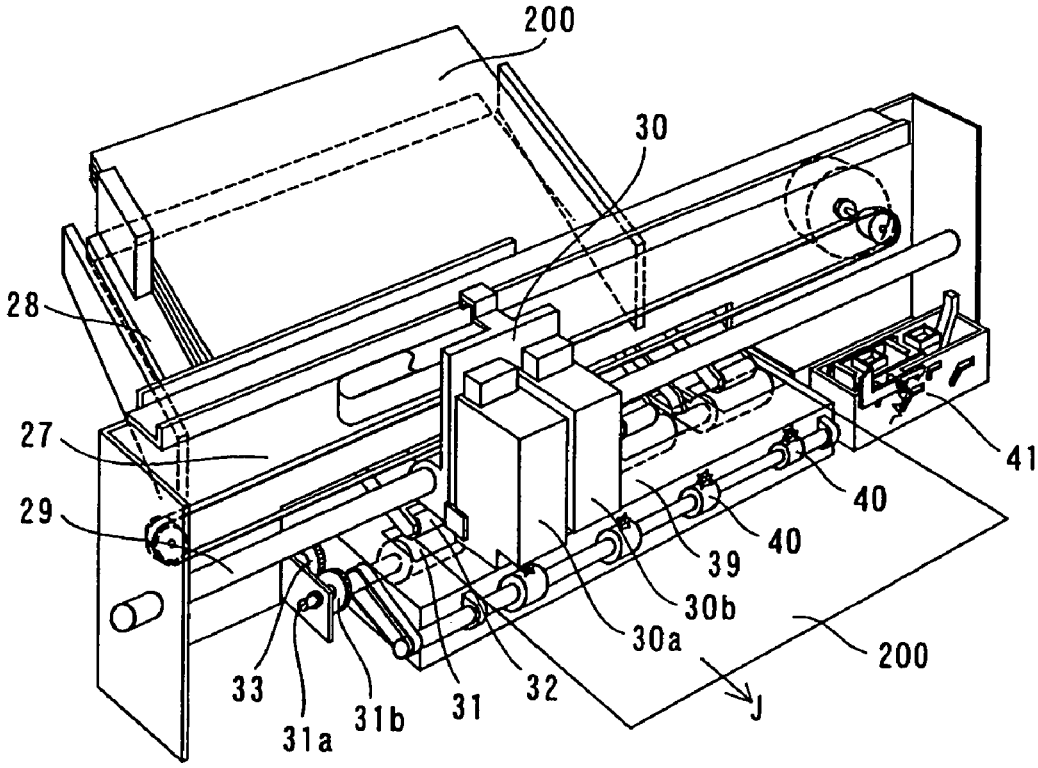
FIG. 6 is a perspective view showing an overall structure of an ink jet printer provided with a sheet feeder according to the second embodiment of the present invention.
Figure 7:
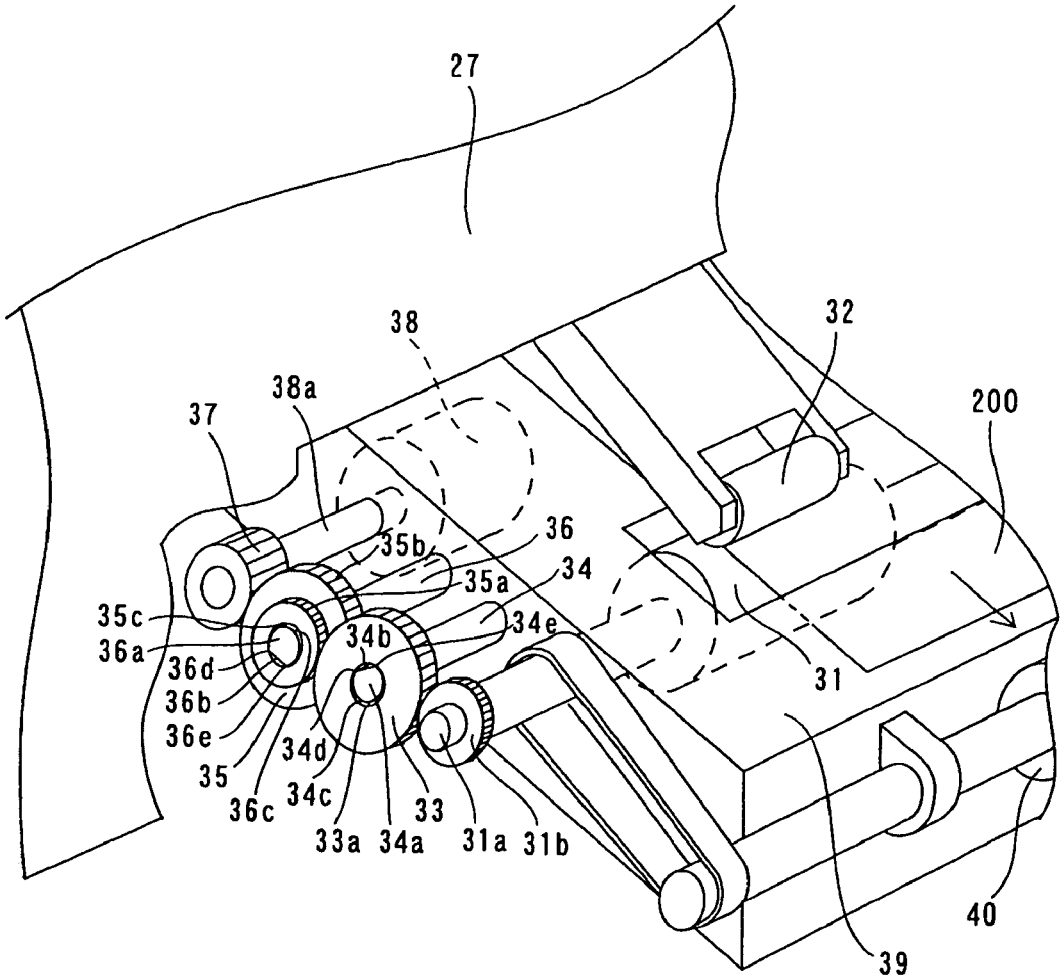
FIG. 7 is a enlarged perspective view showing a sheet feeder of the ink jet printer according to the second embodiment shown in FIG. 6.
Figure 8:
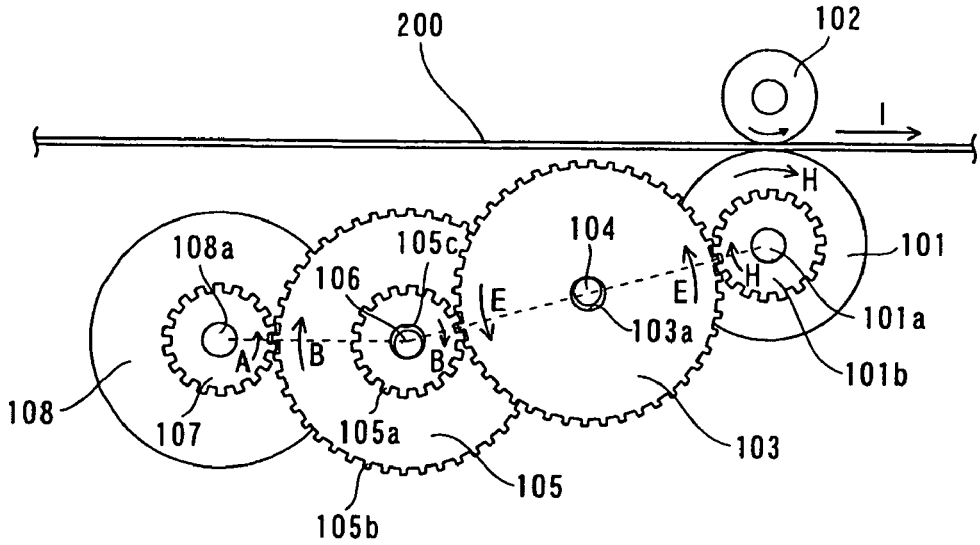
FIG. 8 is a side view showing the structure of a conventional sheet feeder provided with a feed roller for feeding a sheet.
Figure 9:
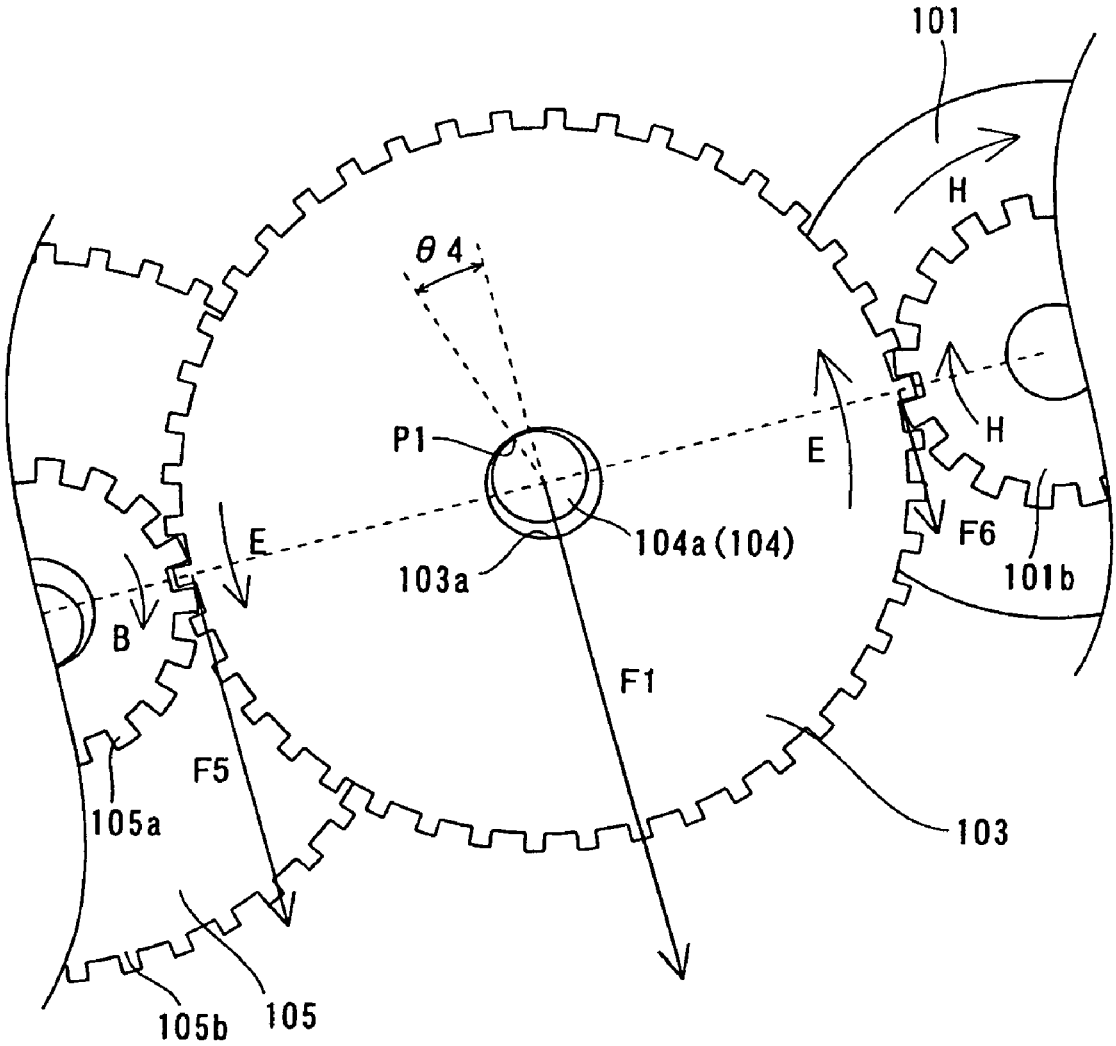
FIG. 9 is an enlarged side view of the first intermediate gear of the sheet feeder according to the conventional example shown in FIG. 8.
Figure 10:
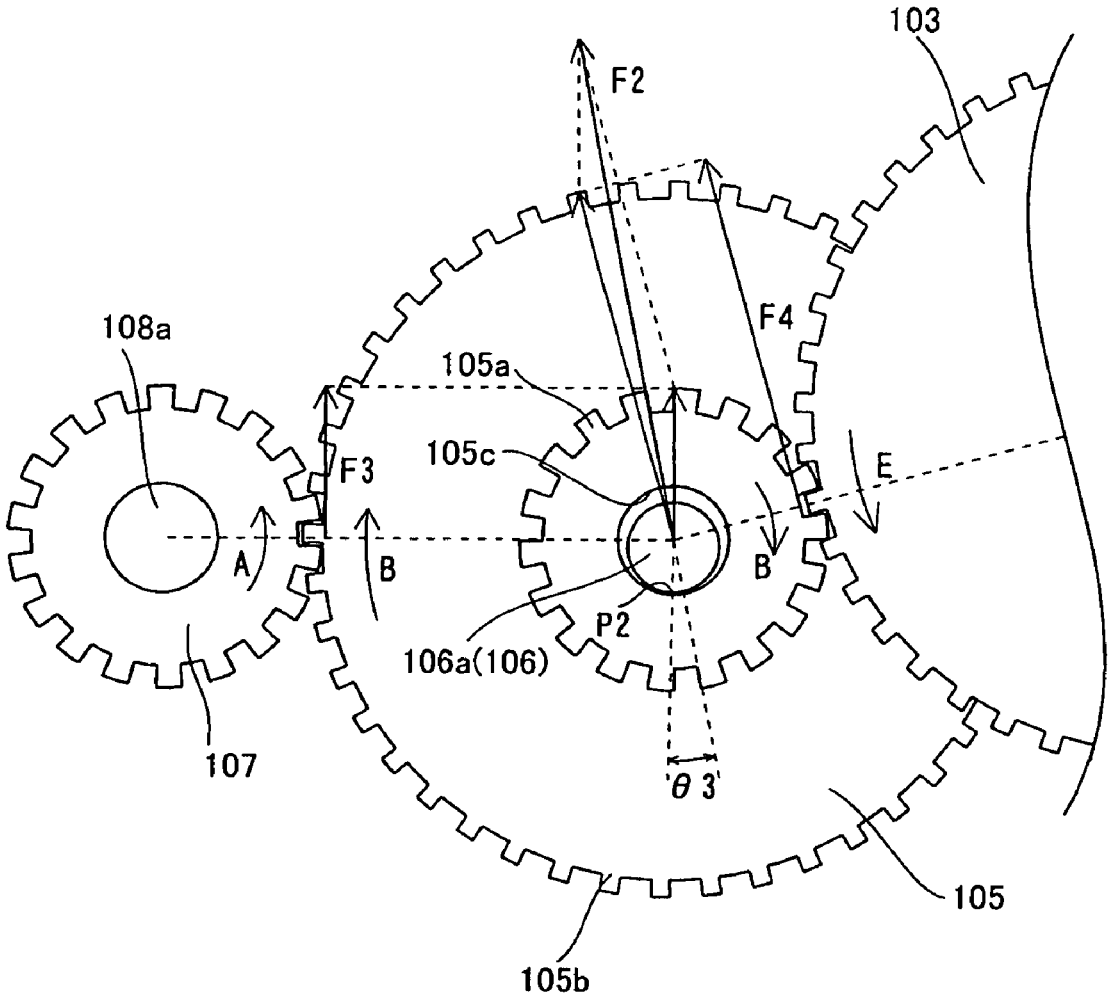
FIG. 10 is an enlarged side view of the second intermediate gear of the sheet feeder according to the conventional example shown in FIG. 8.

FIG. 6 is a perspective view showing an overall structure of an ink jet printer provided with a sheet feeder according to the second embodiment of the present invention. FIG. 7 is a enlarged perspective view showing a sheet feeder of the ink jet printer according to the second embodiment shown in FIG. 6. The example applying the sheet feeder according to the first embodiment to an ink jet printer will be described in the second embodiment referring to FIG. 6 and FIG. 7.

As shown in FIG. 6, a metal chassis 27 is provided in the structure of an ink jet printer according to the second embodiment. A sheet feed tray 28 on which sheets 200 are placed is provided outside of the chassis 27. A metal shaft 29 is attached to the chassis 27. An ink carrier 30 is movably attached to the shaft 29 in a transverse direction. An ink cartridge 30*a* for color and an ink cartridge 30*b* for black and white are attached to the ink carrier 30. An ink nozzle (not shown) for printing is formed on the lower surface of each of the ink cartridges 30*a* and 30*b*.

As shown in FIG. 6 and FIG. 7, a rubber made feed roller 31 for feeding the sheets 200 is provided below ink cartridges 30*a* and 30*b* at a lower center part inside of the chassis 27. The feed roller 31 is provided with a metal rotary shaft 31*a*. As shown in FIG. 7, a resin made feed roller gear 31*b* is fixed to the rotary shaft 31*a* of the feed roller 31. A resin made pinch roller 32 which presses the sheets 200 to the feed roller 31 is provided above the feed roller 31.

A resin made first intermediate gear 33 for rotating the feed roller gear 31*b* is engaged with the feed roller gear 31*b*. A circular bearing 33*a* is formed on the first intermediate gear 33. A bearing engaging part 34*a* of a metal first intermediate gear support shaft 34 which rotatably supports the first intermediate gear 33 is inserted into the circular bearing 33*a* of the first intermediate gear 33.

The bearing engaging part 34*a* has a sectional shape of a substantial D-shaped cut. The bearing engaging part 34*a* having a D-shaped cut is formed by pressing the end part of the metal first intermediate gear support shaft 34 into shapes while the metal first intermediate gear support shaft 34 is pressed into shapes. The bearing engaging part 34*a* having the substantial D-shaped cut contains a flat part 34*b* and a circular part 34*c*. The bearing engaging part 34*a* having the substantial D-shaped cut contains two support parts 34*d* and 34*e* located on the boundary line between the flat part 34*b* and the circular part 34*c*. Two support parts 34*d* and 34*e* are arranged so as to support the circular bearing 33*a* of the first intermediate gear 33 at two positions. The support parts 34*d* and 34*e* have a chamfered or a rounded shape.

A resin made second intermediate gear 35 for rotating the first intermediate gear 33 is provided. The second intermediate gear 35 is provided with a small-diameter gear 35*a* engaged with the first intermediate gear 33 and a large-diameter gear 35*b* having a larger diameter than that of the small-diameter gear 35*a*. A circular bearing 35*c* is formed on the second intermediate gear 35. A bearing engaging part 36*a* of a metal second intermediate gear support shaft 36 which rotatably supports the second intermediate gear 35 is inserted into the circular bearing 35*c* of the second intermediate gear 35.

The bearing engaging part 36*a* has a sectional shape of a substantial D-shaped cut. The bearing engaging part 36*a* having a D-shaped cut is formed by pressing the end part of the metal second intermediate gear support shaft 36 into shapes while the metal second intermediate gear support shaft 36 is pressed into shapes. The bearing engaging part 36*a* having the substantial D-shaped cut contains a flat part 36*b* and a circular part 36*c*. The bearing engaging part 36*a* having the substantial D-shaped cut contains two support parts 36*d* and 36*e* located on the boundary line between the flat part 36*b* and the circular part 36*c*. Two support parts 36*d* and 36*e* are arranged so as to support the circular bearing 35*c* of the second intermediate gear 35 at two positions. The support parts 36*d* and 36*e* have a chamfered or a rounded shape.

As shown in FIG. 7, the large-diameter gear 35*b* of the second intermediate gear 35 is engaged with a driving transmission gear 37 for rotating the second intermediate gear 35. The driving transmission gear 37 is fixed to a drive shaft 38*a* of a motor 38.

As shown in FIG. 6, a resin made base plate 39 is provided below the ink cartridges 30*a* and 30*b*. Discharge rollers 40 for discharging the sheets 200 printed by the ink nozzle (not shown) of the ink cartridges 30*a* and 30*b* are provided on the base plate 39. A maintenance unit 41 for cleaning the ink nozzle (not shown) of the ink cartridges 30*a* and 30*b* is provided at the right side of the front of the base plate 39.

Next, referring to FIG. 6 and FIG. 7, the operation of the ink jet printer according to the second embodiment will be described. The tip of the sheet 200 fed from the sheet feed tray 28 (see FIG. 6) is inserted between the feed roller 31 and the pinch roller 32 in the operation of the ink jet printer according to the second embodiment. The sheet 200 inserted is pressed to the feed roller 31 by the pinch roller 32. In this state, when the motor 38(see FIG. 7) is driven, the driving transmission gear 37 attached to the drive shaft 38*a* of the motor 38 is rotated. The second intermediate gear 35 is rotated based on the rotation of the driving transmission gear 37. In this case, the second intermediate gear 35 is rotated while accepting the force in the upper direction. Even when a force applied by the rotation is fluctuated, two support parts 36*d* and 36*e* of the second intermediate gear support shaft 36 support the circular bearing 35*c* of the second intermediate gear 35 at two positions. Therefore, the fluctuation of the rotation amount of the second intermediate gear 35 is suppressed.

The first intermediate gear 33 is rotated based on the rotation of the second intermediate gear 35. In this case, the first intermediate gear 33 is rotated while accepting the force in the lower direction. Even when the force F1 applied by the rotation is fluctuated, two support parts 34*d* and 34*e* of the first intermediate gear support shaft 34 support the circular bearing 33*a* of the first intermediate gear 33 at two positions. Therefore, the fluctuation of the rotation amount of the first intermediate gear 33 is suppressed. The feed roller 31 is rotated by the rotation of the feed roller gear 31 based on the rotation of the first intermediate gear 33. When the feed roller 31 is rotated, the sheet 200 is fed below the ink nozzles (not shown) of the ink cartridges 30*a* and 30*b* (see FIG. 6). The ink cartridges 30*a* and 30*b* which are at standby on the maintenance unit 41 are moved in a transverse direction when the sheet 200 is fed. Thereby, printing is started by the ink nozzle (not shown) of the ink cartridges 30*a* and 30*b*.

When one line is printed on the sheet 200 while the ink cartridges 30*a* and 30*b* are moved in a transverse direction along the shaft 29, the sheet 200 is fed by one line in the direction of an arrow J shown in FIG. 6 by the rotation of the feed roller 31. One line is printed on the sheet 200 while the ink cartridges 30*a* and 30*b* are moved in a transverse direction again when the sheet 200 is fed by one line. The printing is performed on the entire surface of the sheet 200 by repeating the operation.

In the ink jet printer according to the second embodiment, even when a force that the first intermediate gear 33 and the second intermediate gear 35 accepted by the rotation is fluctuated, the fluctuation of the rotational amounts of the first intermediate gear 33 and second intermediate gear 35 is suppressed. Therefore, the fluctuation of the rotational amount of the feed roller gear 31*b* is suppressed from changing by the fluctuation of the rotational amount of the first intermediate gear 33 and second intermediate gear 35. Thereby, the feeding unevenness of the sheet 200 due to the feed roller 31 is suppressed. Therefore, the gap generated at the printing position due to the ink nozzle (not shown) of the ink cartridges 30*a* and 30*b* is suppressed, and the generation of the printing unevenness caused by the gap of the printing position is suppressed. When the sheet 200 printed reaches the discharge roller 40, the sheet 200 is discharged by the discharge roller 40 and is rotated.

The embodiments disclosed above should be exemplary in every respect, and should not be limited thereto.

For instance, in the first embodiment, two support parts of the bearing engaging part of the first intermediate gear support shaft and of the second intermediate gear support shaft are arranged so as to support the circular bearing at two positions sloping by an equal angle right and left for the line of a force which passes the center of the first intermediate gear and the second intermediate gear, and is applied to the first intermediate gear and the second intermediate gear from the rotation. However the present invention is not limited thereto, one support part may be arranged so as to support the circular bearing at a position sloping by a predetermined angle for the line of a force which passes the center of the first intermediate gear and the second intermediate gear, and is applied to the first intermediate gear and the second intermediate gear from the rotation, and one support part may be arranged on the line of a force which passes the center of the first intermediate gear and the second intermediate gear and is applied to the first intermediate gear and the second intermediate gear from the rotation. Two support parts are arranged so as to support the circular bearing at two positions sloping by a different predetermined angle right and left for the line of a force which passes the center of the first intermediate gear and the second intermediate gear.

In the first and the second embodiment, two gears (the first intermediate gear and the second intermediate gear) are used for transmitting the rotation to the feed roller gear from the driving transmission gear. However the present invention is not limited thereto, and only one intermediate gear may be used for transmitting the rotation to the feed roller gear from the driving transmission gear. Three intermediate gears or more may be used. Even when only one intermediate gear is used and three intermediate gears or more are used, a similar effect can be achieved by the application of the present invention.

In the first and the second embodiment, the bearing engaging parts of the first intermediate gear support shaft and the second intermediate gear support shaft are formed in a substantial D-shaped cut. However the present invention is not limited thereto, and the bearing engaging parts of the first intermediate gear support shaft and the second intermediate gear support shaft may be formed in another shape. For instance, the flat part of the bearing engaging part may be formed in a shape of a recessed curved surface. The circular part of the bearing engaging part may be formed in any other shape other than the rounded shape.

In the second embodiment, an example which applies to a sheet feeder according to the present invention to the ink jet printer is described. However the present invention is not limited thereto, and can be applied to devices other than the ink jet printer. For instance, the present invention can be applied to various image forming devices such as a laser printer and a dye sublimation thermal transfer printer.

Although the present invention has been shown and described with reference to a specific preferred embodiment, various changes and modifications will be apparent to those skilled in the art from the teachings herein. Such changes and modifications as are obvious are deemed to come within the spirit, scope and contemplation of the invention as defined in the appended claims.

What is claimed is:

1. A sheet feeder comprising:

a feed roller rotating around a rotary shaft and feeding a sheet;

a pinch roller pressing the sheet to the feed roller;

a feed roller gear provided on the rotary shaft of the feed roller;

an intermediate gear having a circular bearing and rotating the feed roller gear;

a driving transmission gear attached to a drive shaft of a motor and rotating the intermediate gear based on the drive of the motor;

an intermediate gear support shaft supporting the circular bearing of the intermediate gear rotatably;

the intermediate gear support shaft including a bearing engaging part which has a sectional shape having a D-shaped cut having a flat part and a circular part; and two support parts located on the boundary line between the flat part and the circular part, wherein:

the intermediate gear support shaft is inserted into the bearing of the intermediate gear;

wherein the support parts are arranged so as to support the circular bearing of the intermediate gear at two positions sloping by a predetermined angle right and left for the line of a force which passes the center of the intermediate gear and is applied to the intermediate gear from the rotation; and the two support parts have a chamfered or rounded shape.

2. A sheet feeder comprising:

a feed roller gear provided on a feed roller for feeding a sheet;

a gear containing a circular bearing and rotating the feed roller gear;

a driving transmission gear rotating the gear based on the drive of a motor;

a gear support shaft supporting the gear rotatably;

the gear support shaft including a bearing engaging part which has a circular part and a non-circular part having a shape other than the circular part; and two support parts located on the boundary line between the circular part and the non-circular part, wherein the gear support shaft is inserted into the bearing of the gear; and at least one of the support parts is arranged so as to support the circular bearing of the gear at a position sloping by a predetermined angle for the line of a force which passes the center of the gear and is applied to the gear from the rotation.

3. The sheet feeder according to claim 2, wherein two support parts are arranged so as to support the circular bearing of the gear at two positions sloping by a predetermined angle right and left for the line of a force which passes the center of the gear and is applied to the gear from the rotation.

4. The sheet feeder according to claim 2, wherein the bearing engaging part of the gear support shaft contains a sectional shape having a substantial D-shaped cut having a flat part and a circular part.

5. The sheet feeder according to claim 1, wherein the support parts of the bearing engaging part of the gear support shaft have a chamfered shape.

6. The sheet feeder according to claim 1, wherein the support parts of the bearing engaging part of the gear support shaft have a rounded shape.

* * * * *